United States Patent [19]

Moore

[11] Patent Number: 4,914,766

[45] Date of Patent: Apr. 10, 1990

[54] CONTOURABLE PNEUMATIC CUSHION

[76] Inventor: Boyd S. Moore, 4396 Robinwood Drive, Victoria, British Columbia, V8N 3G8, Canada

[21] Appl. No.: 380,287

[22] Filed: Jul. 17, 1989

[51] Int. Cl.[4] ..... A47C 20/02; A47C 27/10

[52] U.S. Cl. ..... 5/432; 297/DIG. 3; 297/284; 5/455; 5/446

[58] Field of Search ..... 5/432, 433, 455, 456, 5/454, 446; 297/284, DIG. 3, 460; 137/875, 223

[56] References Cited

U.S. PATENT DOCUMENTS

| | | | |
|---|---|---|---|
| 2,136,510 | 11/1938 | Jensen | 297/284 |
| 3,192,541 | 7/1965 | Moore | 297/284 |
| 3,326,601 | 6/1967 | Vanderbilt et al. | 5/432 X |
| 4,017,118 | 4/1977 | Cawley | 297/284 |
| 4,189,181 | 2/1980 | Noble et al. | 5/432 X |
| 4,190,286 | 2/1980 | Bentley | 5/432 X |
| 4,570,676 | 2/1986 | Nishio et al. | 297/284 |
| 4,619,481 | 10/1986 | Grudzinskas | 297/DIG. 3 X |
| 4,634,179 | 1/1987 | Hashimoto et al. | 297/DIG. 3 X |
| 4,759,543 | 7/1988 | Feldman | 297/284 |

FOREIGN PATENT DOCUMENTS 3037659 4/1982 Fed. Rep. of Germany ..... 5/432

*Primary Examiner*—Gary L. Smith
*Assistant Examiner*—Eric K. Nicholson
*Attorney, Agent, or Firm*—Dowrey, Cross & Cole

[57] ABSTRACT

A portable self-contained pneumatic cushion device containing a multiple cell hermetically sealed thermoplastic air bladder within a fabric cover. A pneumatic charging valve is located in one bladder cell which acts as a plenum and a contour control valve is located within another cell. The contour control valve is connected by flexible conduits with the cells and may be opened to circulate air freely between all cells or closed to pneumatically isolate the individual cells. The contour control valve is operated by a finger-pressure squeezing action placed on valve indicators located on the surface of the fabric cover. The cushion can be instantly and simultaneously asymmetrically contoured on both faces by the user to conform to and support an irregularly shaped load applied to both faces of the cushion.

14 Claims, 3 Drawing Sheets

CONTOURABLE PNEUMATIC CUSHION

BACKGROUND OF THE INVENTION

1. Field of the Invention

The present invention relates to a portable self-contained inflatable, multi-cell flexible and hermetically sealed air cushion device. The air cushion device can be asymmetrically contoured on demand to conform to and support an irregularly shaped load applied to both faces of the cushion. In particular, the invention relates to the application of this principle in the construction of contourable pneumatic portable back support cushions. The cushion is usable in combination with existing seating in the same manner as conventional stuffed portable back cushions which require an existing substrate for support. Such substrate would normally be the back of any existing seating means such as an upholstered chair, car seat, patio chair or the like.

2. Description of the Prior Art

Conventional prior art portable back cushions are usually of the stuffed or padded variety and provide a passive support to the user. As a passive support, these cushions flatten out and are impressed into the substrate or seat back under the weight of the user without necessarily providing the desired lumbar support. With these cushions, the greater the weight of the user, the less effective the cushion becomes in providing back support.

In addition to the conventional stuffed cushion, multi-cell pneumatic cushions with control air conduits which provide a certain amount of contouring are known in the prior art. An example of such contourable pneumatic cushions is found in my prior U.S. Pat. No. 3,192,541 entitled CONTOURABLE PNEUMATIC CUSHIONS. My prior patent discloses a cushion in which the communicating air conduits and the contour control valve are arranged externally from the cushion cells and are constructed as an appendage thereto while operating in a hermetically closed cycle. The present invention constitutes an improvement in the concept, utility, operation and construction of my prior patent.

SUMMARY OF THE INVENTION

The present invention consists of a multi-cell orally-inflated thermo-plastic bladder contained within a fabric cover so as to have the appearance of a conventional stuffed or padded cushion. The cover may be provided with means to indicate to the user the exact location of the contour control valve located within the bladder. Such means may taken the form of a graphic indicator such as a low profile button, a color or textile identifier or by various other means of drawing the user's attention to the presence and location of the contour control valve. The bladder consists of horizontally displaced cells which are operationally interconnected by means of independent tubular air communication lines to the contour control valve. All components are hermetically sealed within the bladder while the oral inflation valve is accessible to the user. The inflation valve may taken the form a single retractable valve which is bonded to the back face of one cell of the bladder. A two-position multi-port contour control valve is utilized to distribute charge air to each of the bladder cells as dictated by the user and then to hermetically isolate each cell following such contouring action. Thus, the volumetric air charge of each cell can be controlled by the user to contour the cushion to accommodate his/her anatomy and posture and then the bladder cells may be hermetically isolated by closing the contour control valve ports.

The amount of oral inflation applied to the cushion's bladder may be varied to obtain the bladder volumetric displacement required to suit the seating condition and comfort requirement of the user. This is accomplished without sacrificing the instant contourability feature of the invention which enables effective back support and comfort over an infinite range of seating conditions. The invention is therefore, by design, an active support device since its support profile on each face of the cushion can be instantly adjusted on user command to accommodate the back support and comfort requirements of the user in any seating means having an existing seat back.

As will be readily appreciated by those familiar with the art, the present invention overcomes the above-described disadvantages of the conventional stuffed cushion. The cushion of the present invention first impresses itself into and conforms forms itself to the surface of the substrate under the weight of the user to provide the ultimate basis for anatomical back support. Under user command the cushion is also simultaneously and asymmetrically contoured on the user's side to provide the desired back support and comfort. The selected contour is then held indefinitely or until recontoured by the user.

In contrast to my prior U.S. Pat. No. 3,192,541, the present invention provides for the air communicating means and contour control valve to be located within the air bladder cells and hermetically sealed perimeter of the bladder. These elements are thus not under the stress associated with externally mounted air lines and contour control valve. The resulting device is a fully portable, independent, and self contained pneumatic back cushion having a longer service life. In addition, gas losses (air leaks) within the contour air operating system cannot cause deflation of the cushion bladder since internal leakages are recycled during the contouring activity. Likewise, the present invention utilizes one of the cushion bladder cells and not the contour control valve as the plenum means for mixing air during contouring action. Thus it is not necessary to admit charging air directly to the contour control valve but rather the charging air is admitted to one cell of the bladder only. Also, since the air cells are not mounted on a rigid back plate and thereby constrained, the contouring of the cushion is not limited to only one face of the cushion.

In my prior patent, the air cells are individually formed so as to be mounted upon and bonded to one face of the pneumatic cushion. The air cells of the present invention on the other hand are formed by bonding floating divider walls to both faces of the cushion bladder so as to enable independent and asymmetric contouring on both faces of the cushion. An unbroken support profile is also ensured on both faces of the cushion which contributes to greater seating comfort. The simultaneous contourabilty of both faces of the cushion bladder combined with floating cell divider walls enables a variable volumetric air displacement capability not possible with my prior patent. Further distinctions between the present invention and the prior art, including my prior patented device, will be understood from the following description and accompanying drawings.

DETAILED DESCRIPTION OF THE INVENTION

The invention in its broadest aspects relates to portable self-contained inflatable multi-cell and hermetically sealed air cushion which may be adapted for a variety of uses and a wise range of functional requirements. The following specification describes an embodiment of the invention which is direction specifically to a portable back rest cushion for use in such environments as chairs and car seats or the like for illustrative purposes and not by limitation. It will be apparent to those skilled in the art that the contourable backrest cushion according to the present claimed invention could be incorporated into any seating means during the design and construction thereof.

Figure 1:
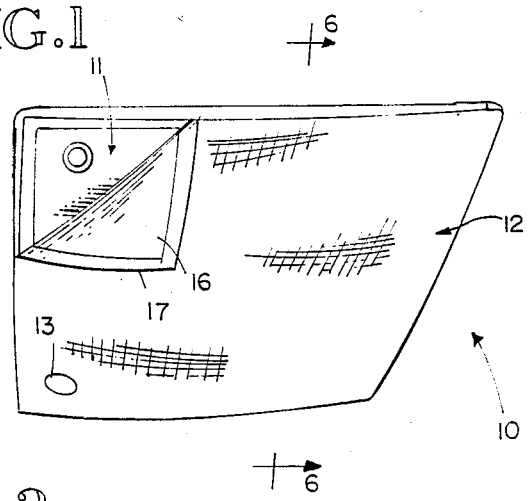
FIG. 1 is a perspective view of the invention in the ready-to-use position illustrating the location of the contour control valve indicator and the means providing access to the inflation valve.

FIG. 1 is a perspective view of a back rest cushion indicated generally at 10 which includes the hermetically sealed air bag or bladder 11 and a suitable decorative cover 12 which may be applied to both faces of the bladder to obtain the desired decorative effect. As will presently be described the bladder 11 will be constructed from a suitable flexible thermoplastic film and may be anchored to the cover by conventional means to prevent shifting of the bladder within the cover. In order to accomplish this, a fabric tape may be sewn to the peripheral flange of the bladder and the fabric cover in turn sewn to the tape. Alternatively the fabric cover may be sewn directly to the peripheral flange. A graphic indicator 13 is carried by both faces of the cover and serves to indicate to the user the location of the contour control valve, presently to be described in detail. The bladder 11 is fitted with a retractable inflation valve 14 adjacent one corner of the bladder. In order to provide access to the inflation valve, the overlying corner of the cover 12 is formed as a flap 16 which may be, folded back so as to expose the surface of the bladder containing the valve. The flap 16 may be normally held against the perimeter of the bladder by such means as Velcro strips 17 or the like.

According to the present embodiment, the contour control valve indicator 13 is carried by the bladder cover 12 and has no attachment to the bladder surface. It will be understood that both faces of the cushion cover will be provided with a suitable indicator 13 in the same relative location. The indicators 13 will be positioned so as to overlie the contour control valve contained within the hermetically sealed bladder as will presently be described. The indicator 13 may take any one of many possible forms such as a low profile button or raised surface on the cover fabric. Other expedients such as a distinctive colored area, a textile identifier or any other means of drawing the user's attention to the presence and location of the contour control valve may be utilized.

Figure 2:
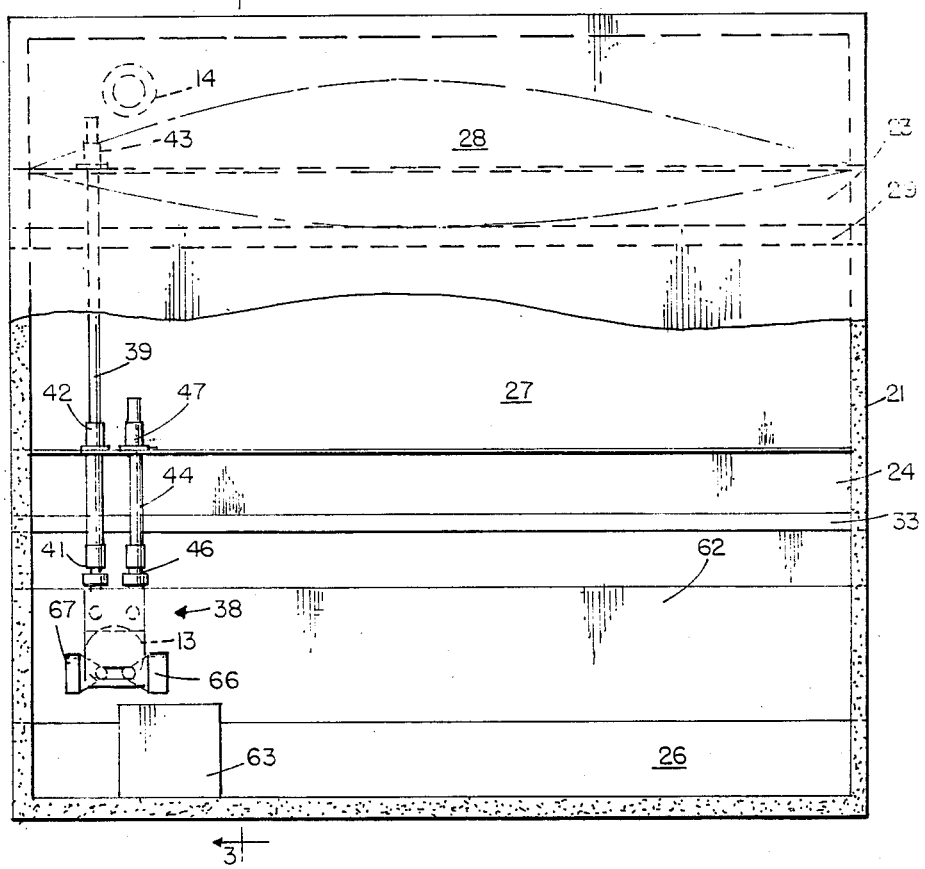
FIG. 2 is a top plan view of the bladder with the upper face of the bladder partially removed and showing certain of the cell divider walls in section.
Figure 3:
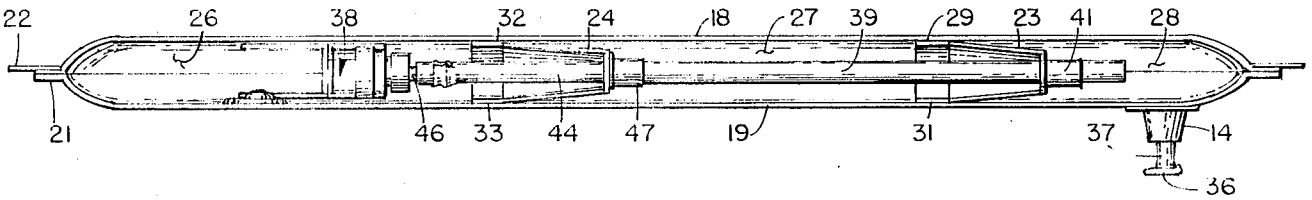
FIG. 3 is a cross sectional view of the bladder taken along lines 3—3 of FIG. 2 showing the conduits 39 and 44 in elevation.

FIGS. 2 and 3 illustrate the details of construction of the hermetically sealed air bladder and the location of the internal air control system. Referring to FIG. 3, the bladder is formed by the two sheets of flexible thermoplastic film which constitute the front face or wall 18 and a substantially identical rear wall or face 19. Although the dimensions of the cushion in plan view may be varied, the rectangular or square configuration as shown in FIG. 2 is a typical design. The front and rear faces of the bladder are sealed about the outer periphery to form a hermetically sealed flange 21 extending completely around the periphery of the cushion. The bladder may be made from a wide variety of synthetic materials such as PVC or polyurethane film, typically of 10–20 mil thickness. Polyurethene films are available which provide excellent all weather properties such as flexibility and resistance to cracking in cold weather. Since these films are thermoplastic, the seal around the flange 21 may be accomplished by such means as dielectric welding to fuse the materials. As aforementioned, a fabric strip 22 may be attached such as by sewing or otherwise to the flange 21 to facilitate the attachment of the cover means 12 in the form of a decorative fabric or the like.

The bladder is provided with individual cells in the present embodiment by the insertion of cell divider diaphragm walls 23 and 24. The walls 23 and 24 will be constructed from strips of the same thermoplastic material as the bladder faces and will be dielectrically bonded thereto along the entire length of their opposite longitudinal edges so as to maintain an airtight seal between the cells. The diaphragm walls serve to form the individual cells 26, 27 and 28 as viewed in FIG. 3 and are characterized as floating or shifting cell walls. These floating divider walls provide for a smooth continuous contour on each face of the cushion and enable variable volumetric charging of each individual cell depending on the demands of the user. The divider walls 23 and 24 may be identical, with the wall 23 being dielectrically welded to the inside of the front face at 29 and to the rear face at 31. Likewise the flexible divider wall 24 is welded to the front face at 32 and to the rear face at 33. As seen most clearly in FIG. 2, the divider walls 23 and 24 are thus welded to the front and rear faces of the bladder along the entire length of both longitudinal edges so as to have the ends thereof included in the peripheral flange weld 21.

Figure 3A:
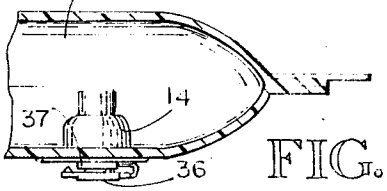
FIG. 3*a* is a cross sectional detail illustrating the retracted position of the inflation valve.

The inflation valve 14 may be a conventional soft plastic retractable valve well known in the art. These valves are commercially available and are usually characterized by an integral removable plug or cap 36 for insertion into the stem portion 37. The valve unit 14 must be an airtight valve, a common design of which also includes an internal check valve. The check valve permits filling but requires a squeezing action of the valve stem 37 in order to allow air to escape from the sealed bladder. Although many types of inflation valves may be utilized, it is preferably characterized as a soft retractable valve which may be made airtight and which may be pushed into the bladder wall so as to be substantially flush therewith. FIG. 3*a* illustrates the inverted or retracted position of the valve. It will be noted that the inflation valve communicates directly with the cell 28. The inflation charge is communicated to the additional two cells by means of the air conduit system present to be described.

As seen most clearly in FIG. 2, the hermetically sealed cells 26, 27 and 28 extend completely across the bladder with the cell 28, containing the inflation valve 14, acting as an air plenum. The cell 26 at the opposite end of the cushion is provided with the contour control valve unit 38 which is mounted completely within the cell. Cell 26 thus serves as the bladder air mixing chamber when the contour control valve is in the pneumatic interconnection mode, since the control valve 38 ports directly into cell 26 when in such pneumatic interconnection position. A first flexible conduit 39 is connected to the valve unit 38 in cell 26 and communicates directly with the cell 28. The conduit 39 is attached to the valve unit 38 by means of the nipple 41 on the valve body and extends through the walls members 23 and 24 by means of the tubing flanges 42 and 43 respectively. The tubing flanges are commercially available plastic fittings which may be dielectrically bonded to the divider wall strips and serve to form air tight seals between conduit 39 and the divider walls. The conduit 39 thus connects the plenum cell 28 directly with the valve unit 38 in the cell 26 and extends completely through and is sealed with respect to cell 27. A second conduit 44 is connected to the valve unit 38 by the nipple 46 and extends through the wall 24 via a tube flange 47. The tube flange 47 may be identical with the tube flanges 42 and 43 previously described. With this arrangement, it will be seen that charging air from the plenum cell 28 may be admitted to cells 26 and 27 only via the conduit 39, valve 38 and conduit 44.

Figure 5:
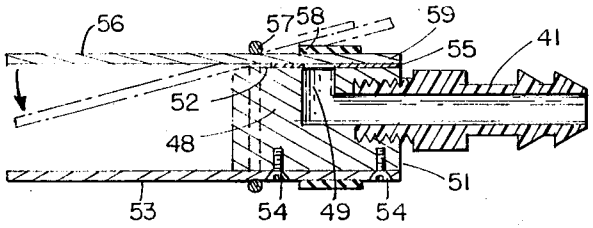
FIG. 5 is a cross sectional view taken along lines 5—5 of FIG. 4.
Figure 4:
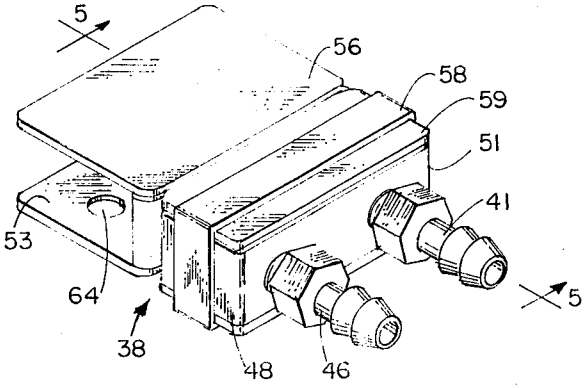
FIG. 4 is a perspective view of the contour control valve.

With reference to FIGS. 4 and 5, the contour control valve 38 comprises a two position multiport valve for controlling the passage of air from the plenum cell 28 to the cells 26 and 27 at the command of the user. The valve 38 includes a valve block or body 48 having several bores one of which is shown at 49 in FIG. 5. The parallel bores extend from the front face 51 of valve block to the upper flat surface 52 of the block. Each of the bores is provided with a screw threaded nipple fitting for the attachment of an air conduit. The nipple fittings may be screw threaded into suitable screw threaded openings in the valve block as illustrated in FIG. 5. The valve block 48 is mounted to a fixed plate 53 by such means as the cap screws 54 or any other suitable fastening means and includes an upper movable plate 56 which is designed to hinge or pivot relative to the valve block 48 by means of the wire hinge member 57. The hinge plate 56 is movable between the full line and the dotted line positions shown in FIG. 5 for the purpose of opening and closing the valve ports. The plate 56 is held in the valve closed position by means of the elastic band 58 which extends around the end of the hinge plate and the valve block. The band 58 holds the valve cover section 59 of the plate in the port blocking position as seen the solid lines in FIG. 5.

A valve seat or seal is provided for the valve ports by means such as a vinyl strip 55 which serves to prevent air losses about the ports when the valve is in the closed position. The valve may be opened and closed by a simple squeezing action on the plates 53 and 56. Finger pressure on the hinged plate 56 moves the plate to the dotted line position shown in FIG. 5 allowing air passage from the valve ports. The bias of the elastic band closes the valve upon release. Although one specific embodiment of contour control valve has been illustrated and described utilizing the elastic band closure means, it will be apparent to those skilled in the art that a differing contour control valve embodiment and valve operating means may be used in accomplishing the same function while falling within the scope of the invention as claimed.

FIGS. 2 and 3 illustrate the manner in which the contour valve 38 may be attached to the cushion bladder within the cell 26. To accomplish this, a plastic anchor strip 62 extends completely across the bladder and may be welded into the peripheral flange 21 on opposite sides of the bladder. The valve 38 is connected to the strip 62 which provides an anchor and lateral support for the valve. A second anchor strip 63 is attached to one edge of the strip 62 immediately adjacent the valve and is also welded into the peripheral flange 21 of the cushion. The anchor strips 62 and 63 thus provide bi-directional stability to the valve within the cell 26. As seen in FIG. 4 the fixed plate 63 of the valve is provided with holes 64 which may be used to attach the valve securely to the anchor tabs 66 and 67 which are in turn welded to the anchor strip 62. Alternatively, the valve 38 may be welded directly to the bladder face 19 as shown in FIG. 3 by means of the anchor tabs 66 and 67. The positioning of the valve indicators 13 on each face of the cushion cover will correspond with and overlie the fixed and movable plates 53 and 56 respectively to allow the use to apply finger pressure on the indicators for operation of the valve 38.

In order to assemble the bladder, the inflation valve 14 is first dielectrically bonded to the outer surface of the rear face 19 about a suitable opening in the face for air passage. The tubing flanges 42, 43 and 47 for the conduits 39 and 44 are then dielectrically bonded to the respective diaphragm walls of the cells with suitable openings in the walls being made for the placement of the conduits. The diaphragm cell divider walls 23 and 24 are then welded in place to the front and rear faces of the bladder as previously explained. Next, the contour control valve 38 is connected to the anchor strip 62 by means of the dielectrically welded tabs 66 and 67 and the conduits 39 and 44 are connected to the valve nipples. The valve assembly and anchor strip is inserted between the bladder faces 18 and 19 and the conduits 39 and 44 inserted through the tubing flanges into their respective air cells. The entire bladder assembly is then laid flat to cause to the cell divider diaphragm walls to assume the deflated position shown in FIG. 3. The perimeter of the bladder may then be dielectrically welded around the flange 21 to form an hermetically sealed air bag containing the entire contour air operating system and forming the three hermetically sealed cells.

Operation

To use the invention, the cushion bladder 11 is orally inflated by means of the valve 14 to the inflation volume desired as dictated by the seating condition. The cushion is then placed against the seat back of a particular seating means. While leaning against the cushion to exert an external force on certain areas of the cushion in accordance with the postural comfort and support position desired, the user squeezes the graphic indicators 13 on both faces of the cushion cover. The contour control valve 38 is thus caused to open and establish pneumatic communication between the air cells 26, 27 and 28 of the bladder which then asymmetrically contour themselves on the opposite faces of the cushion. The contouring, of course, is in accordance with the seating condition and the comfort requirements of the user. When the required comfort level is achieved, the user release pressure on the graphic indicators causing the contour control valve 38 to close and block further air passage between the cells. The closing of the valve returns the cells to a state of hermetic isolation in a condition of properly contoured fit determined by the user. The cushion will now hold the selected contour indefinitely. In the event the user wishes to recontour the cushion for a different postural position or if the cushion is to be employed by another person, the cushion may be recontoured by simply repeating the procedure. The contour control valve 38 is reopened by squeezing the indicators 13 and, while leaning against the cushion in the postural postion desired, the contour valve is release and allowed to close. Closing of the valve will again lock the cells in a state of hermetic isolation as required to meet the revised contour and comfort demands of the user.

Figure 6:
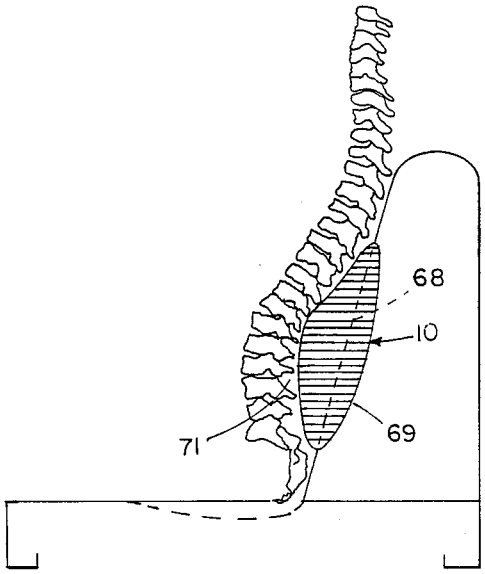
FIG. 6 is a schematic view showing the cushion in cross sectional outline as viewed along line 6—6 of FIG. 1 and illustrating the asymmetric contourability of the cushion under the weight of the user.
Figure 7:
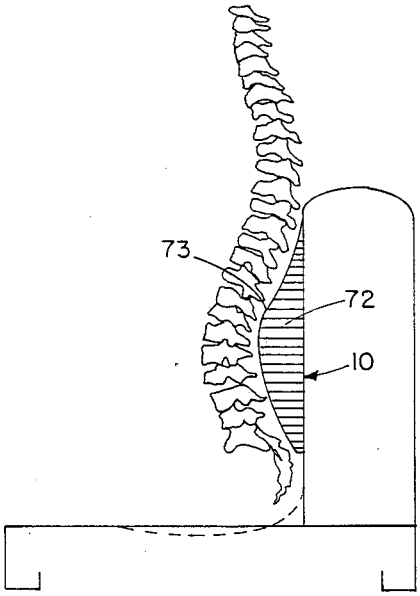
FIG. 7 is a schematic view, similar to FIG. 6, showing the cushion in cross sectional outline and illustrating the principal of the invention wherein the volumetric displacment of the cushion can be selected to suit the seating requirement while retaining asymmetrical contourability.

The principal of asymmetric contourability of the cushioning device of the present invention may be more readily understood with reference to FIGS. 6 and 7. These figures represent a cross sectional outline of the cushion taken along lines 6—6 of FIG. 1. Referring to FIG. 6 in particular, under the weight of the user and while the contour control valve is held in the open position, the cushion 10 contours itself on its back face to conform to the substrate which has been deflected from its unladen state shown in dotted lines at 68 to its laden profile at 69. Simultaneously and independently the cushion contours itself on the user's side at 71 to provide an unbroken support profile which conforms to the postural needs of the user. Once the cushion is asymmetrically contoured, the contour control valve is allowed to close to maintain the selected contour indefinitely.

Referring to FIG. 7, the initial volumetric air charge of the cushion may be varied without sacrificing the cushion's ability to be asymmetrically contoured. Thus the user's side of the cushion is contoured for the back support demanded. As shown in FIG. 7, as the contour control valve is held in the open position, the cushion 10 first conforms to a hard and unyielding substrate 72 under the weight of the user while being simultaneously contoured on the user's side 73 by the user to provide the comfort and support demanded. Once the cushion is properly contoured, the contour control valve is closed.

The embodiment of the invention as described herein is by way of illustration of one application of the present invention and not by way of limitation. Modifications may be made to application, shape, configuration, dimensions, material, methods of control and construction without sacrificing any of the principles and features as hereunder claimed. It will also be apparent to those skilled in the art that while the hermetically sealed system of the invention is preferably charged with air, any other suitable gas may be utilized.

What is claimed is:

1. A pneumatic cushion comprising, in combination;
a bladder,
means within said bladder forming a plurality of hermetically sealed cells,
charging valve means for admitting a pneumatic charge to one of said cells,
contour control valve means in another of said cells, and
pneumatic communication means connecting said control valve means with each said cells,
said control valve means having a first position for interconnecting said cells and a second position for pneumatically isolating said cells.

2. The combination according to claim 1 wherein;
said bladder comprises opposing flexible bladder faces hermetically sealed about the periphery thereof, and
said cell divider walls comprise spaced flexible members extending between said bladder faces and bonded thereto to form said cells,
whereby said said bladder face presents a continuous independently contourable cushion surface.

3. The combination according to claim 1 wherein;
said bladder comprises opposing flexible bladder faces hermetically sealed about the periphery thereof,
said contour control valve is located entirely within the associated cell, and
means for anchoring said control valve within its associated cell,
said control valve being operable by pressure applied to the outer surfaces of said opposing bladder faces for pneumatically interconnecting said cells and then isolating the cells to retain the asymmetrical contour on said bladder faces.

4. The combination according to claim 2 wherein;
said contour control valve is located entirely within the associated cell, and
means for anchoring said control valve within its associated cell,
said control valve comprising fixed and movable valve opening and closing means located adjacent the bladder faces in the interior thereof and selectively operable by pressure applied to the outer surfaces of said opposing bladder faces,
whereby the pneumatic charge in said one cell may be selectively caused to circulate between said cells responsive to pressure on said contourable cushion surfaces and then said cells pneumatically isolated to retain the individual volumetric charge therein at any given contour.

5. The combination according to claim 4 wherein said divider walls comprise flexible diaphragm members permitting variable volumetric charging of adjacent cells.

6. The combination according to claim 5 wherein said charging valve means comprises;
a flexible valve steam hermetically sealed to one of said opposing bladder faces for admitting a charge to only said one cell, and
valve closure means in said stem for permitting oral charging of said one cell,
said valve stem having a first position extending outwardly from the outside surface of the bladder face and a second retracted position extending completely within the bladder.

7. The combination according to claim 6 including;

decorative cover means covering the outside surfaces of said bladder faces and fixed relative thereto, said cover means including flap means overlying said charging valve and releasable fastener means to retain said flaps in position over said valve.

8. The combination according to claim 7 wherein said decorative cover includes;

control valve indicator means on each face thereof, said indicator means overlying said fixed and movable valve opening and closing means, whereby the user may accurately locate said contour control valve for asymmetrically contouring said cushion.

9. The combination according to claim 8 wherein;

each said opposing bladder faces constitute a continuous flexible contourable surface providing an unbroken support profile on each face of said cushion.

10. The combination according to claim 3 including;

decorative cover means covering the outside surface of said bladder faces and fixed relative thereto, and control valve indicator means on each face of said cover, said indicator means overlying said control valve, whereby the user may accurately locate said contour control valve for asymmetrically contouring said bladder faces.

11. The combination according to claim 3 wherein said cell divider walls comprise flexible diaphragm members permitting variable volumetric charging off adjacent cells.

12. The combination according to claim 11 wherein;

each said opposing bladder faces constitutes a continuous flexible contourable surface providing an unbroken support profile on each face of said cushion.

13. An asymmetrically contourable pneumatic cushion comprising, in combination;

a flexible hermetically sealed cushion bladder, flexible divider wall means within said bladder, said divider wall means providing shiftable diaphragm members forming a plurality of variable volumetric, hermetically sealed cells within said bladder, air charging valve means in a first one of said cells for admitting an air charge to said first cell only, contour control valve means in a second one of said cells, and flexible air conduit means connecting said contour control valve means with said cells, said contour control valve means having a first open position for pneumatically interconnecting said cells and a second closed position for pneumatically isolating said cells, whereby the air charge in said one cell may be selectively caused to circulate between said cells in the first position of said control valve and then said cells pneumatically isolated to retain the individual volumetric charge therein at any given contour by movement of said control valve to said second position.

14. The combination according to claim 13 wherein said contour control valve includes finger-pressure responsive valve operating means and including;

decorative cover means covering the outside surface of said bladder and fixed relative thereto, contour control valve indicator means on opposed faces of said cover means overlying said valve operating means, whereby the user may accurately locate said contour control valve for asymmetrically contouring said bladder.

* * * * *